United States Patent [19]

Sasaki et al.

[11] Patent Number: 4,983,938

[45] Date of Patent: Jan. 8, 1991

[54] BAND-STOP FILTER

[75] Inventors: Kanemi Sasaki, Hamura; Sadao Ogawa, Fussa, both of Japan

[73] Assignee: Kokusai Electric Co., Ltd., Tokyo, Japan

[21] Appl. No.: 422,785

[22] Filed: Oct. 17, 1989

[30] Foreign Application Priority Data

Nov. 21, 1988 [JP] Japan ..... 63-295542

[51] Int. Cl.[5] ..... H01P 1/202

[52] U.S. Cl. ..... 333/207; 333/223; 333/226

[58] Field of Search ..... 333/202, 206, 207, 222–226, 333/235

[56] References Cited

U.S. PATENT DOCUMENTS

| | | | |
|---|---|---|---|
| Re. 32,768 | 10/1988 | D'Avello et al. | 333/202 |
| 4,179,673 | 12/1976 | Nishikawa et al. | 333/204 |
| 4,255,729 | 3/1981 | Fukasawa et al. | 333/202 |
| 4,342,972 | 8/1982 | Nishikawa et al. | 333/222 X |
| 4,386,328 | 5/1983 | Masuda et al. | 333/202 |
| 4,426,631 | 1/1984 | D'Avello et al. | 333/202 |
| 4,431,977 | 2/1984 | Sokola et al. | 333/206 |
| 4,434,410 | 2/1984 | Miyake et al. | 333/224 |
| 4,546,334 | 10/1985 | Nishikawa et al. | 333/286 |
| 4,703,291 | 10/1987 | Nishikawa et al. | 333/206 X |

FOREIGN PATENT DOCUMENTS

| | | | |
|---|---|---|---|
| 0035560 | 3/1980 | Japan | 333/206 |

*Primary Examiner*—Eugene R. LaRoche
*Assistant Examiner*—Seung Ham
*Attorney, Agent, or Firm*—David O'Reilly

[57] ABSTRACT

A band-stop filter comprises a plurality of resonator units each comprised of an end-shorted coaxial resonator and a variable condenser connected in series therewith, a printed circuit board combining said resonator units in a multistage having thru-holes adjacent a bushing which isolates the inner conductor of the end-shorted coaxial resonator from the printed circuit board. A thru-hole conductor is provided in the thru-hole, and an adjusting screw having a radius is a little larger than the thru-hole. The adjusting screw can have both the proper torque and the electrical connection. The inner conductor surface of the resonator operates electrically as a stator and the adjusting screw operates as a rotor.

4 Claims, 3 Drawing Sheets

BAND-STOP FILTER

BACKGROUND OF THE INVENTION

1. Field of the Invention

This invention relates to a band-stop filter using coxial resonators to stop undesired wave, which is applied to a radio communication apparatus.

2. Prior Art

Prior art band-stop filters as shown in FIG. 5(*a*) (*b*), comprise resonator units each of which have a end-shorted coxial resonator 1 and a variable condenser 2 for adjusting frequencies connected in series therewith. Printed circuit board 3 combines the resonator units in a multistage configuration, having a hole 10 adjacent bushing 4 which isolates an inner conductor of end-shorted coaxial resonator 1 from the printed circuit board 3. A screw holder 9 is soldered to the printed circuit board 3. Adjusting screw 6 is threaded into and held by screw holder 9 with the proper torque. By rotating adjusting screw 6, it is possible to adjust the resonant frequency.

This band-stop filter, however, has problems because the cost of machining screw holder 9 is high and the height of the screw holder 9 requires space.

SUMMARY OF THE INVENTION

This invention has been made with a view to overcoming the problems mentioned above.

This invention, therefore, provides as its principal object the provision of a novel band-stop filter which can be made small and at low cost.

Namely, according to the invention, a band-stop filter comprises several resonator units each of which has an end-shorted coaxial resonator and a variable condenser or capacitor for adjusting frequencies connected in series therewith. A printed circuit board combines the resonator units in a multistage configuration, and has a thru-hole adjacent to a bushing that isolates the inner conductor of the end-shorted coaxial resonator from the printed circuit board. A conductive coating is provided in the thru-hole and an adjusting screw having a radius a little larger than the hole through the conductive coating is threaded into the hole forming threads in the conductive coating.

Because the adjusting screw has a little larger radius than the conductive, the adjusting screw provides both the proper torque and electrical connection. Further the inner conducting surface of the resonator operates electrically as the stator and the adjusting screw operates as the rotor of a cylindrical variable condenser. Therefore by rotating the adjusting screw and shifting it axially, it is possible to adjust the resonance frequency.

BRIEF DESCRIPTION OF THE DRAWINGS

FIG. 5(*b*) is a front view of a prior art band-stop filter.

In FIG. 1,2 and 3, end-shorted coaxial resonator 1, and a variable capacitor 2 are connected in series resulting in a resonator unit. These resonator units are combined in several stages. For example, two stages are shown combined through a printed circuit board 3. On printed circuit board 3, earth conductor 3*a* and two connecting conductors 3*b* and 3*b* are formed. Earth conductor 3*a* and conductor 3*b* are connected to a pair of end-shorted coxial resonators 1 and 1. Between earth conductor 3*a* and two connecting conductors 3*b* and 3*b*, there are connected coils 7,7 providing anti-resonance points in the passing band. Between the two connecting conductors 3*b* and 3*b*, in other words, between the connecting points of a pair of variable condensers 2,2 and coil 7,7, there is a coupling condenser or capacitor 8 connected respectively.

Figure 1:
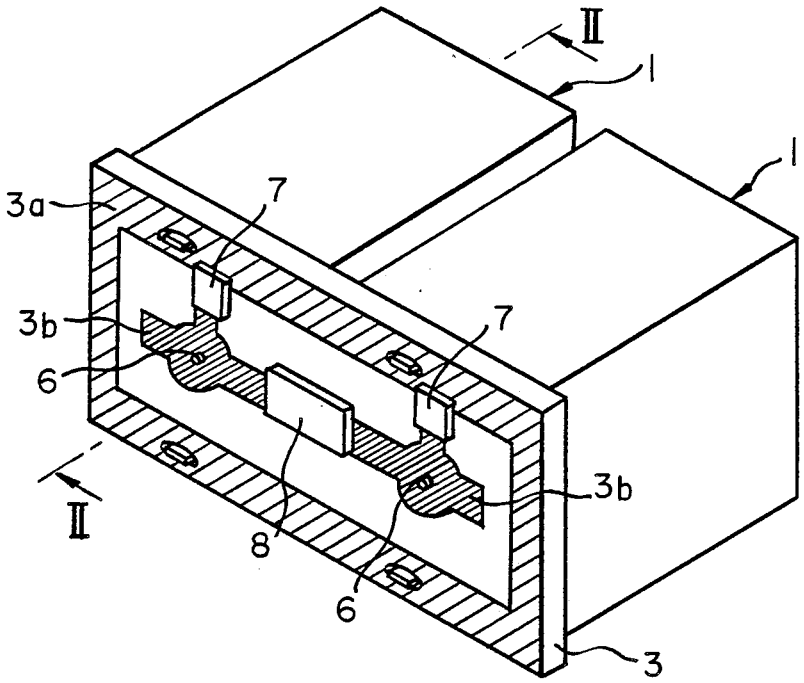
FIG. 1 is a perspective view of a preferred embodiment of a band-stop filter according to the invention.
Figure 2:
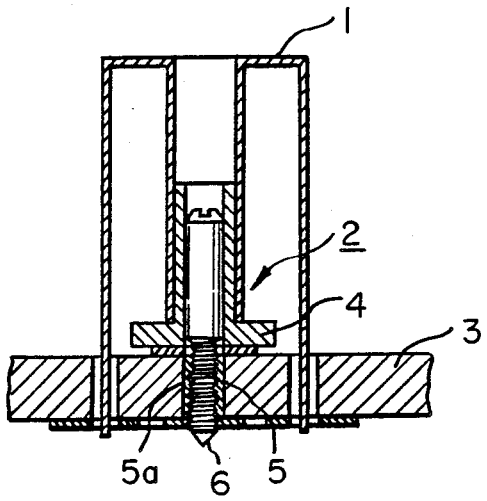
FIG. 2 is a cross-sectional view along line II—II of FIG. 1.
Figure 3:
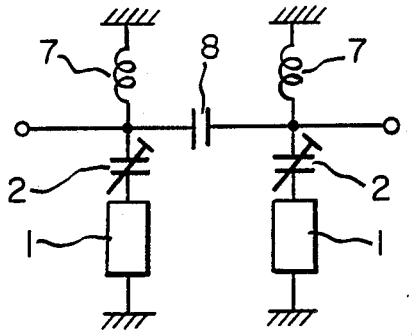
FIG. 3 is an electrical equivalent circuit of FIG. 1.

Variable capacitor 2 is formed by bushing 4 inserted into end-shorted coaxial resonator 1 to provide electrical isolation. Thru-hole 5 adjacent bushing 4 is provided on printed circuit board 3. Thru-hole 5 is coated with a plating 5*a*, and an adjusting screw having a little larger radius than the hole formed by plating 5*a* is threaded into the hole forming threads in the plating 5*a*.

Figure 4A:
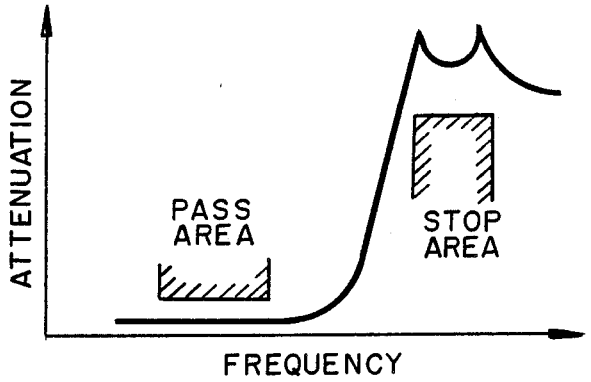
FIG. 4(*a*) and (*b*) are graphs showing the examples of the band-stop filter characteristics.
Figure 4B:
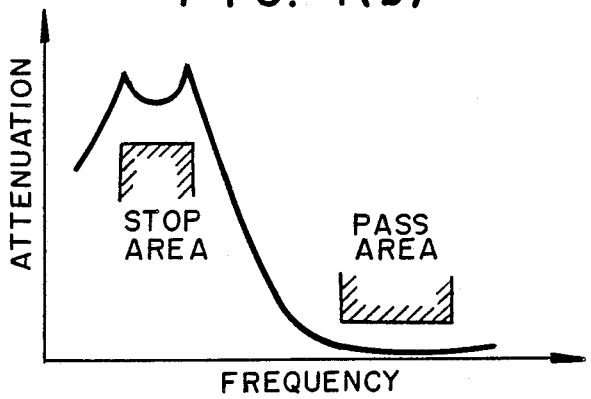
Figure 5A:
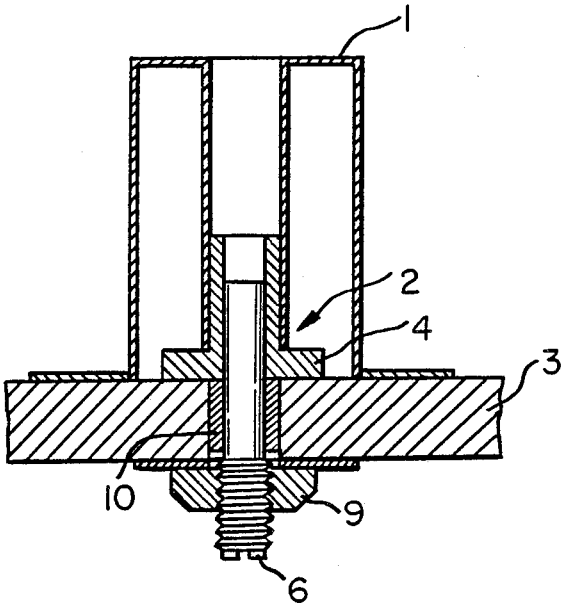
FIG. 5(a) (PRIOR ART)
FIG. 5(*a*) is a cross-sectional view of a prior art band-stop filter.
Figure 5B:
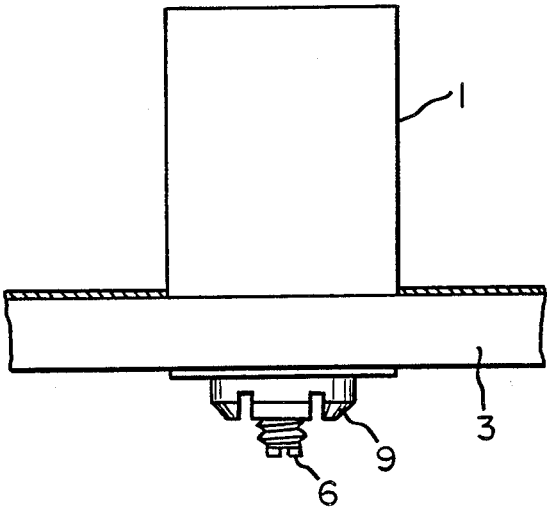
FIG. 5(b) (PRIOR ART)

In the above-mentioned construction, by choosing the proper the condenser 8, connecting coil 7,7 and the resonator units, it is possible to get the filter characteristics shown in FIGS. 4(*a*) or (*b*). In this case coil 7 might become a negative value or be unnecessary under the influence of a detuning of the pass band and the stop band and required attenuation. If the desired reactance value of coil 7 is negative, it may be replaced with a condenser to achieve the required characteristics of the filter.

Because adjusting screw 6 has a little larger radius than plating 5*a* in thru-hole 5, it provides both the proper torque and electrical connection. Further the inner conductor surface of resonator 1 operates electrically as a stator and adjusting screw 6 operates as a rotor of the cylindrically variable condenser. Therefore by rotating the adjusting screw and shifting it axially by means of drivers etc., it is possible to adjust the resonant frequency.

For example, by using printed circuit board 3 made from BT(bismaleimide-triazine) resin having a width of 0.5 mm, a thru-hole plating 5*a* with a radius of 0.9 mm, an adjusting screw with a radius of 0.95 mm and a pitch of 0.25 mm, it is possible to get both the proper torque which prevents loosening as in well as the prior art and an effective electrical connection.

Since both sides of printed circuit board 3 are covered with copper, adding thru-hole 5 does not affect processing of the product, and it is possible to produce by a standard manufacturing process. Therefore printed circuit board 3 adds little to the cost. If anything it is lower cost because there is no need for screw holder 9 of prior art.

When using this embodiment in a mobile communication apparatus, soldering between the point of adjusting screw 6 and thru-hole pattern on the printed circuit board 3 after adjusting the frequency makes it possible to improve the stability under vibrations or shocks.

Even when the resonator of this invention is made of coaxial dielectric resonator, it should be apparent that the same effect as the above embodiment can be achieved.

We claim:

1. A band-stop filter comprising;

a plurality of resonator units, each of said plurality of resonator units having an end-shorted coaxial resonator and a variable frequency control means for adjusting frequencies connected in series;

printed circuit board means;

said plurality of resonator units being multi-stage connected by said printed circuit board means;

said printed circuit board means having thru-holes adjacent a bushing in each of said plurality of resonator units, said bushing isolating an inner conductor of each of said end-shorted coxial resonators from said printed circuit board means;

coil means on said printed circuit board means connecting each of said plurality of resonator units to ground;

a coupling capacitor on said printed circuit board means connecting adjacent pairs of said plurality of resonator units;

said thru-holes in said printed circuit board means being coated with a conductor; and a frequency adjusting screw having a radius slightly larger than the hole formed by said conductive coating being threaded into said conductive coating.

2. A band-stop filter according to claim 1 in which said series connected variable control means is a variable capacitor.

3. A band-stop filter comprising;

a plurality of resonator units, each of said plurality of resonator units having an end-shorted coaxial resonator and a variable frequency control means for adjusting frequencies connected in series;

printed circuit board means;

said plurality of resonator units being multi-stage connected by said printed circuit board means;

said printed circuit board means having thru-holes adjacent a bushing in each of said plurality of resonator units, said bushing isolating an inner conductor of each of said end-shorted coaxial resonators from said printed circuit board means;

capacitive means on said printed circuit board means connecting each of said plurality of resonator units to ground;

a coupling capacitor on said printed circuit board means connecting adjacent pairs of said plurality of resonator units;

said thru-holes in said printed circuit board means being coated with a conductor; and a frequency adjusting screw having a radius slightly larger than the hole formed by such conductive coating being threaded into said conductive coating.

4. A band-stop filter according to claim 3 in which said series connected variable control means is a variable capacitor.

* * * * *